United States Patent [19]

Conklin et al.

[11] 4,019,084

[45] Apr. 19, 1977

[54] PYROELECTRIC VIDICON HAVING A PROTECTIVE COVERING ON THE PYROELECTRIC TARGET

[75] Inventors: Thomas H. Conklin, Ridgefield, Conn.; Barry M. Singer, New York, N.Y.

[73] Assignee: North American Philips Corporation, New York, N.Y.

[22] Filed: Oct. 2, 1975

[21] Appl. No.: 618,768

[52] U.S. Cl. ..... 313/388; 250/330; 250/333; 313/94

[51] Int. Cl.[2] ..... H01J 31/00

[58] Field of Search ..... 250/330, 332, 333, 334, 250/338, 340; 313/366, 376, 387, 388

[56] References Cited

UNITED STATES PATENTS

| | | | |
|---|---|---|---|
| 3,725,711 | 4/1973 | Sadler | 313/366 X |
| 3,928,768 | 12/1975 | Crowell | 250/338 X |

*Primary Examiner*—Rudolph V. Rolinec
*Assistant Examiner*—Lawrence J. Dahl
*Attorney, Agent, or Firm*—Frank R. Trifari; Carl P. Steinhauser

[57] ABSTRACT

In a pyroelectric vidicon, the target is covered with a layer of vacuum compatible material which has a high secondary emission coefficient, a low first cross-over and low conductivity to prevent decomposition of the target.

2 Claims, 2 Drawing Figures

PYROELECTRIC VIDICON HAVING A PROTECTIVE COVERING ON THE PYROELECTRIC TARGET

The invention relates to a pyroelectric vidicon and in particular to a target for the vidicon which does not readily decompose even under operating conditions.

Pyroelectric vidicons employ as targets materials such as tri-glycine sulfate, tri-glycine fluoberylliate, alanine triglycine sulfate, and others which are vaccum unstable, i.e. they decompose in vacuum, especially when heated by incident electrons of a beam used to scanned the target. This decomposition of the target will liberate gases into the vacuum that are harmful to the thermionic cathode, and eventually the operation of the vidicon will cease.

It is an object of this invention to protect the target of a pyroelectric vidicon against decomposition and the release of harmful gases into the tube.

It is a further object of this invention to improve the performance and extend the life of a pyroelectric vidicon.

These and further objects of the invention will appear as the specification progresses.

In accordance with the invention we provide a protective coating in the form of a vacuum compatible layer on the surface of the target of the pyroelectric material. This layer must not only be vacuum compatible and seal the surface of the pyroelectric target, but it must also have a relatively high secondary emission coefficient, a low first cross-over and a low conductivity. Moreover, such materials must be capable of being applied without destruction of target, i.e. they must be capable of being deposited at a low enough temperature to avoid decomposition of the target material which, being a poor heat conductor, readily decomposes above its decomposition temperature.

We have found that the materials $Al_2O_3$, $Si_3N_4$ and $SiO_x$, $1<x<2$ fulfill all the aforesaid requirements and can be deposited on the pyroelectric target by known methods.

The invention will therefore be described with reference to the accompanying drawing and following detailed description:

Figure 1:
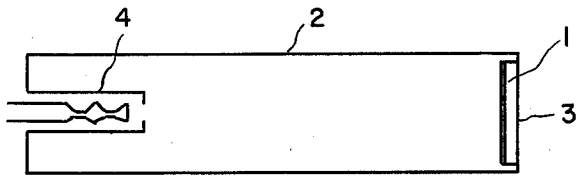
FIG. 1 shows a pyroelectric vidicon embodying the invention.
Figure 2:
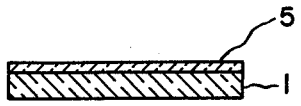
FIG. 2 shows the target structure in greater detail.

The pyroelectric target 1 of a vidicon 1 is mounted at one end of an evacuated envelope 2 with one end facing a window 3 transparent to visible and infra-red radiation.

The other side of the target, facing the vacuum, is scanned by an electron beam generated by an electron gun 4.

The target, conventionally tri-glycine sulfate (TGS), is unstable, i.e. it decomposes releasing components into the vacuum, especially when heated by the electron beam used to scan its surface. In order to minimize the evaporation of such components which would be detrimental to the operation of the vidicon, the surface of the target facing the electron gun is covered with a layer 5 of a material which effectively seals the surface and prevents decomposition of the pyroelectric material. This layer consists of a material which is vacuum compatible, i.e. it does not decompose even upon heating to release components which are detrimental to the operation of the tube. It also has a high secondary emission coefficient, e.g. $> 1$, a low first cross-over, i.e. the potential at which secondary electrons are emitted by the target is low causing a secondary electron shower, and it has a low conductivity, i.e. a resistivity $>$ 10 ohms-cm.

All these conditions are met by one or more of the materials described above. However, we prefer to use $SiO_x$ $(1 < x < 2)$ which is deposited as a layer by resistively heating a tantalum boat with SiO with a partial pressure of $O_2$ of about $2 \times 10^{-6}$ torr so that SiO oxidizes and forms $SiO_x$ where $x$ is very close to 2. A layer having a thickness of about 500–1000A is thus deposited which seals the surface of the pyroelectric material and prevents decomposition products from entering the vacuum.

Instead of (TGS), the pyroelectric material may, of course, by tri-glycine fluoberylliate, alanine tri-glycine sulfate, or any other well-known pyroelectric material.

What is claimed is:

1. In a pyroelectric vidicon including an evacuated envelope having a pyroelectric target at one end and an electron gun at the other end for scanning a surface of the target, said target consisting of a material which is unstable in a vacuum and decomposes upon heating and selected from the group consisting of tri-glycine sulfate, tri-glycine fluoberylliate and alanine tri-glycine sulfate, the improvement wherein the surface of said target exposed to the vacuum is covered with a protective coating of a vacuum compatible material having a relatively high secondary emission coefficient, a low first cross-over and a low conductivity, said latter material being selected from the group consisting of $Al_2O_3$, $Si_3N_4$ and Si $O_x$, $x$ being between 1 and 2.

2. A pyroelectric vidicon as claimed in claim 1 wherein the material of the pyroelectric target is tri-glycine sulfate and said vacuum compatible material is Si $O_x$, $x$ being between 1 and 2.

* * * * *